United States Patent [19]

Sprague

[11] 4,101,758

[45] Jul. 18, 1978

[54] ELECTRIC STEAM GENERATOR HAVING A MOVABLE DISTRIBUTION MEANS

[75] Inventor: Brinton Sprague, Bainbridge Is., Wash.

[73] Assignee: Cam Industries, Inc., Kent, Wash.

[21] Appl. No.: 755,200

[22] Filed: Dec. 29, 1976

[30] Foreign Application Priority Data

Jul. 13, 1976 [CH] Switzerland ..... 4989/76

[51] Int. Cl.[2] ..... H05B 3/60; F22B 1/30

[52] U.S. Cl. ..... 219/285; 219/273; 219/288; 219/289; 338/80

[58] Field of Search ..... 219/271–276, 219/284–295; 338/80–86

[56] References Cited

FOREIGN PATENT DOCUMENTS

| | | | |
|---|---|---|---|
| 168,622 | 7/1951 | Austria | 219/284 |
| 927,528 | 5/1947 | France | 219/285 |
| 685,856 | 12/1939 | Fed. Rep. of Germany | 219/284 |
| 728,299 | 11/1942 | Fed. Rep. of Germany | 219/288 |
| 897,317 | 11/1953 | Fed. Rep. of Germany | 219/288 |
| 207,778 | 2/1940 | Switzerland | 219/288 |

*Primary Examiner*—A. Bartis
*Attorney, Agent, or Firm*—Kenyon & Kenyon Reilly Carr & Chapin

[57] ABSTRACT

An electric steam generator includes a vessel housing at least one dish-shaped electrode having a bottom with a plurality of openings. A water distribution means is spaced above each electrode and provides a plurality of water jets which impinge on the electrode. The water distribution means is movable relative to the electrode to adjust the number of jets which impinge on the electrode. A stationary collecting means is provided between the water distribution means and the electrode for intercepting the excess water. Each collecting means is also located out of vertical alignment with the respective electrode. The distribution means are fixed to a rotatable pipe which serves to move the distribution means and through which water can be fed to the distribution means. A collecting grid is disposed below each of the electrodes to collect the water jets issuing from the opening in the bottom of each electrode.

8 Claims, 6 Drawing Figures

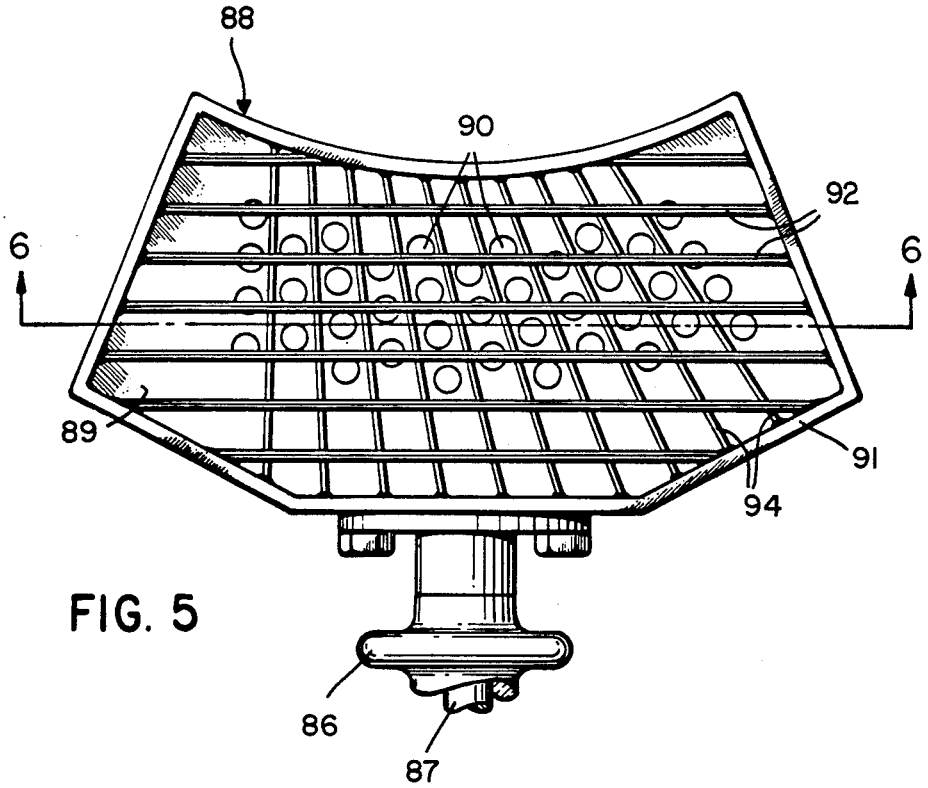
FIG. 5
FIG. 6
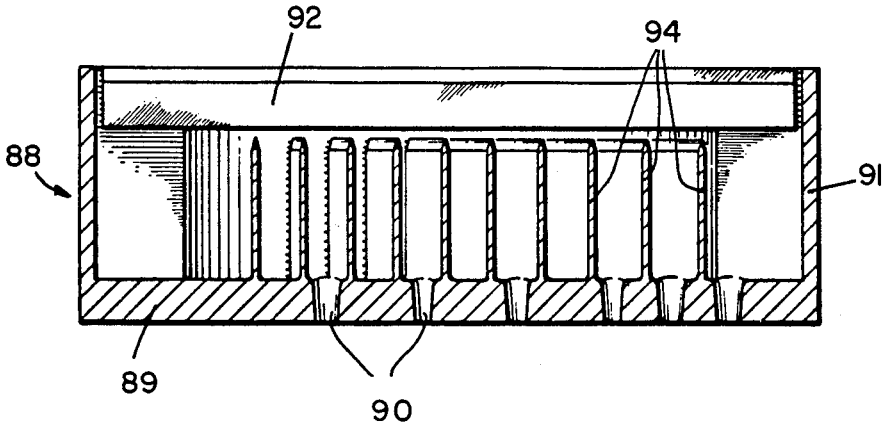

ELECTRIC STEAM GENERATOR HAVING A MOVABLE DISTRIBUTION MEANS

This invention relates to an electric steam generator. More particularly, this invention relates to an electric steam generator having a movable distribution means.

Heretofore, various electric steam generators have been known in which at least one electrode is arranged in a vessel with a distribution device for directing the water to be evaporated against the electrode in the form of jets. In one known case, as described in pending U.S. Pat. application Ser. No. 720,737, filed Sept. 7, 1976 as well as Swiss Pat. 592,842, the electrodes are each constructed as a horizontally extending dish which has openings for forming vertical water jets, and the distribution device is fixed above the electrode and forms a water chamber having an approximately horizontal bottom which, for each electrode, has a group of openings which serve to form vertical water jets. In addition, means are provided so that, for partial load of the steam generator, the water flowing toward the electrode is fed only to a part of the openings in the electrode. This latter means consists of a movable intercepting device which can be moved into the space between the distribution device and the electrode located underneath in order to prevent more or fewer water jets from striking the electrode. However, such a steam generator still has a relatively large overall height because the distance between the upper side of the electrode and the underside of the intercepting device inserted below the distribution device must not be less than a certain value as otherwise there is danger of the current arcing over.

Accordingly, it is an object of the invention to further reduce the height of known steam generators.

It is another object of the invention to provide a compact electric steam generator of minimal height.

Briefly, the invention provides an electric steam generator having a vessel and at least one horizontally extending dish-shaped electrode in the vessel with a horizontally movable water distribution means located above the electrode and a collecting means which is mounted in stationary manner in the vessel between the water distribution means and the electrode vertically out of alignment with the electrode.

The water distribution means has a chamber to receive water as well as a group of openings in a horizontal bottom in the chamber and above the electrode for directing water jets against the electrode. The horizontal dish-shaped electrode functions so as to receive and heat the water supplied from the water distributor and has openings forming outlets for the received water to form vertical water jets. A collecting grid is also positioned in the generator vessel below the electrode to collect the water jets discharged from the electrode.

The water distribution means is mounted for movement in a range between a first position corresponding to a partial load on the generator and a second position corresponding to a full load on the generator. The stationary collecting means is mounted in a horizontal plane and is disposed below at least a portion of the distribution means at all times, i.e. when the distribution means is within the range between the partial load and full load positions.

In use, the collecting means serves to intercept the water jets which are not to strike the electrode. For this purpose, depending on the load, the water distribution means is moved horizontally relative to the electrode so as to impinge more or less water jets on the electrode and, conversely, more or less water jets into the collecting means.

Because the water distribution means is movable and the collecting means is stationary and is outside of the current-carrying water jets, the distribution means can be arranged closer to the electrode. Thus, the overall height of the steam generator can be reduced. In addition, advantages as to the mechanical construction of the steam generator are obtained, which permit cost savings in production.

According to a particularly advantageous embodiment of the invention, the water distribution means comprises a pipe which is coaxial with the axis of the vessel and which is supported on a central pipe stub which protrudes into the bottom of the vessel. The pipe end which is supported on the stub is located at a point below the level of a water sump in the vessel. In addition, a suitable means is provided by feeding water from the sump within the vessel through the pipe stub into the pipe. The bearing between the pipe of the distribution means and the central pipe stub is bridged here by the water of the sump which acts as an electric conductor. Therefore, there are only negligibly small voltage differences between the bearing surfaces, so that corrosion due to voltage differences is avoided.

These and other objects and advantages of the invention will become more apparent from the following detailed description and appended claims taken in conjunction with the accompanying drawings in which:

FIG. 5 illustrates a plane view of an electrode of the steam generator of FIG. 1; and FIG. 6 illustrates a view taken on line VI — VI of FIG. 5.

Figure 1:
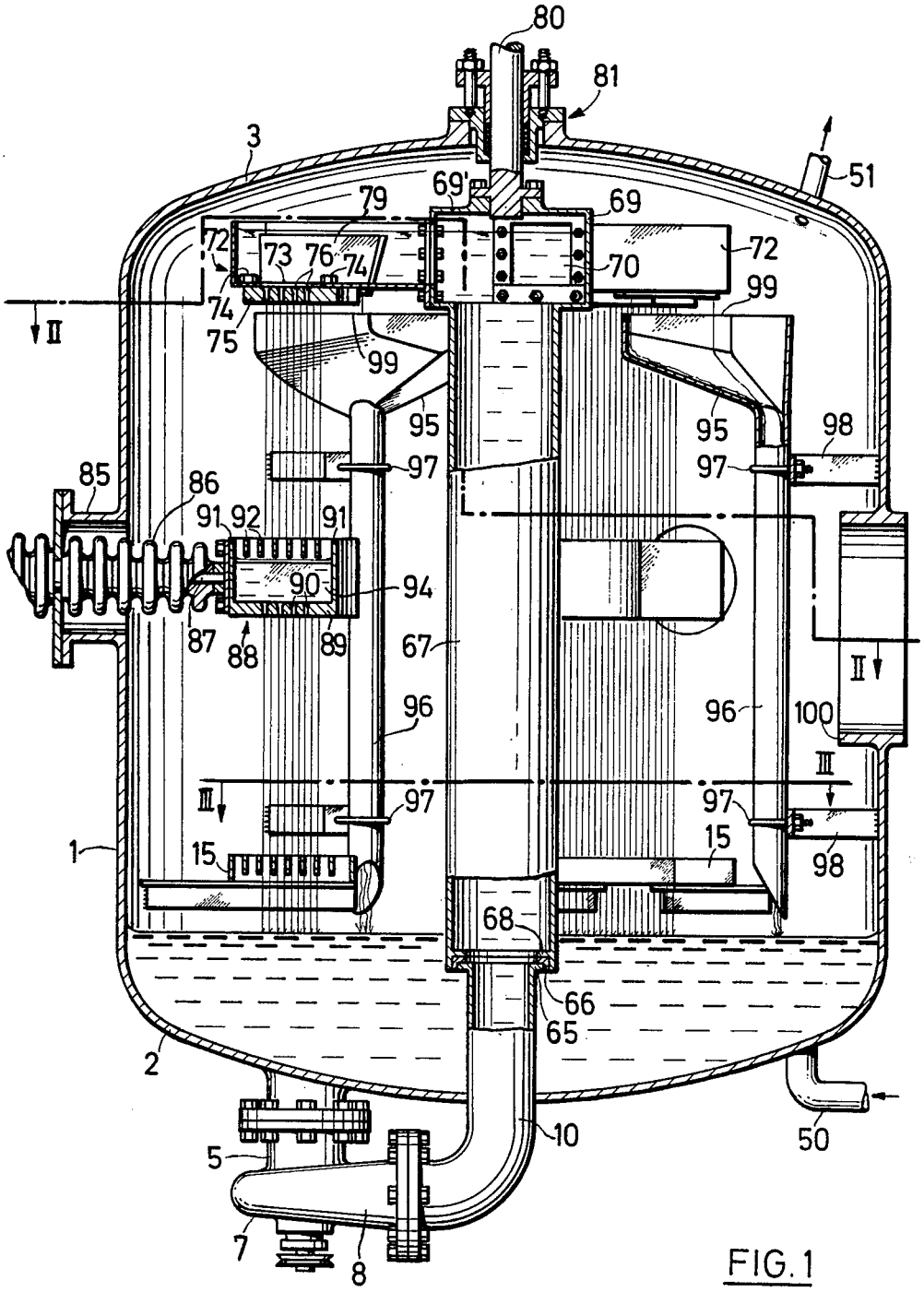
FIG. 1 illustrates a vertical cross-sectional view through a steam generator according to the invention.

Referring to FIG. 1, the steam generator comprises a cylindrical vessel 1 which is disposed on a vertical axis and is provided at the top and bottom with suitable convex covers 3, 2 respectively. The lower end of the vessel 1 serves as a water sump and an outlet spigot is connected to the bottom cover 2 to communicate with a suction stub 5 of a circulating pump 7. An output stub 8 of the pump 7 is connected to a flanged pipe stub 10 which is centrally located of the vessel 1 and protrudes upwardly through the vessel bottom cover 2. The pipe stub 10 terminates at a flange 65 somewhat below the level of the water sump. A bearing ring 66 of angular cross-section is arranged on the flange 65 to surround the flange 65 on the outside with a downward directed rim.

Figure 2:
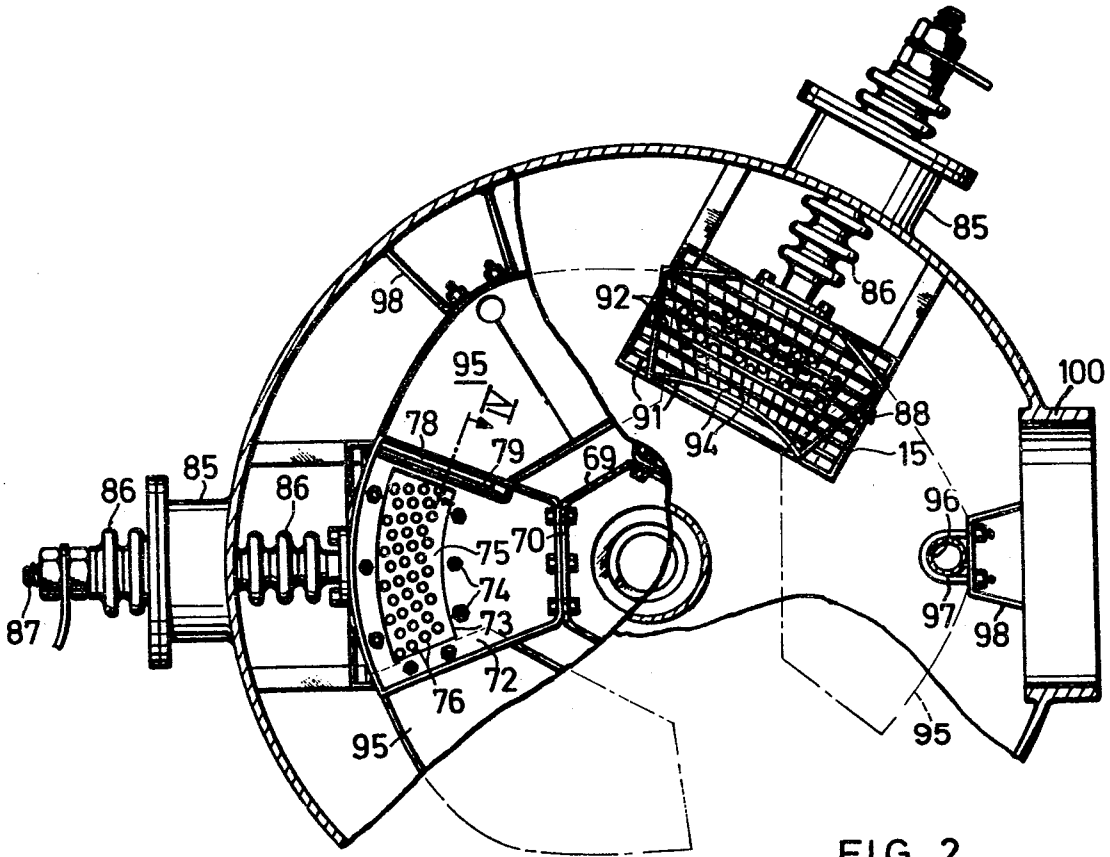
FIG. 2 illustrates a partial view taken on line II—II of FIG. 1.

The vessel 1 houses a water distribution means which is constructed to form a multiplicity of downwardly flowing vertical water jets. This distribution means includes a vertical pipe 67 which is mounted on the bearing ring 66 to rotate about the axis of the vessel. This pipe 67 is formed at the lower end with an inward projecting flange 68 which rests on the bearing ring 66. The section of the pipe 67 located below the flange 68 encloses the outer circumference of the bearing ring 66. The upper end of the rotatable pipe 67 terminates in a hexagonal housing 69 which has a rectangular opening 70 in each of three walls. The three openings 70 are thus arranged at an angle of 120° to each other. A distribution box 72 which is open at the top and is bolted to the respective wall of the housing 69 via gaskets (not shown) is connected to each opening 70 to form a chamber to receive water. The distribution boxes 72 have the shape of a truncated sector as seen in a top view (FIG. 2). The horizontal bottom of each distribution box 72 is provided an opening in the shape of a ring sector 73 which is covered from below by a nozzle plate 75 which is fastened to the bottom of the distribution box 72 by means of screws 74. The nozzle plate 75 has a group of nozzle openings 76 which are arranged in rows in such a manner that the rows are slightly askew to the axis of rotation of the pipe 67. These openings serve to discharge vertical water jets.

Figure 4:
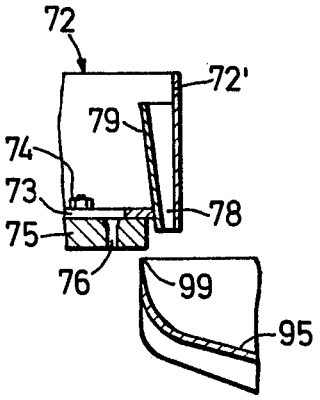
FIG. 4 illustrates a view taken on line IV-IV of FIG. 2.

Referring to FIGS. 2 and 4, each distribution box 72 has a slightly inclined sheet metal plate 79 near one boundary wall 72' which forms a slot 78 for the chamber. As shown, the slot 78 widens towards the top. The plate 79 functions as a partition to separate the slot 78 from the remainder of the chamber in the box 72 such that the slot 78 can function as an overflow opening.

Referring to FIG. 1, in order to drive the pipe 67, a rotatable drive shaft 80 is bolted to a cover 69' of the hexagonal housing 69 via a flange and extends through the upper end, i.e. cover 3, of the vessel 1. In addition, a stuffing gland 81 is mounted in the cover 3 to seal the drive shaft 80 in the cover 3. The drive shaft 80 is in connection with drive means (not shown) via which a rotary motion of about 45° can be imparted to the rotatable pipe 67 including the three distribution boxes 72, and more specifically, clockwise from the position shown in FIG. 2 and back again. In this way, the distribution boxes 72 can be moved in a range between a first position corresponding to a partial load on the generator and a second position corresponding to a full load on the generator.

Figure 3:
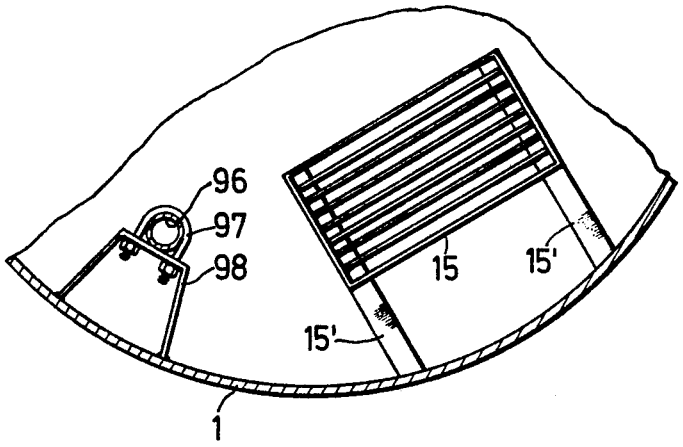
FIG. 3 illustrates a partial view taken on line III-III of FIG. 1.

Three horizontally extending dish-shaped electrodes 88 are arranged underneath the full-load position of the distribution boxes 72 spaced by 120° over the circumference of the vessel 1. Each of these electrodes 88 is supported by a conductor rod 87 which projects into the vessel space radially and is mounted in a stub 85 of the vessel. The conductor rods 87 serve to supply current and are each surrounded by an insulator 86. As shown in FIGS. 2, 5 and 6, each electrode 88 consists of a horizontal bottom 89 and an adjoining upward-extending frame 91. The bottom 89 is provided with nozzle outlets 90, which are arranged, corresponding to the nozzle openings 76 of the distribution boxes 72, in rows which are slightly askew to the axis of the rotatable pipe 67. Vertical partitions 94 are provided between each two adjacent rows of nozzle outlets 90 and extend from the bottom to about two-thirds of the height of the frame 91 (FIG. 6). Collecting rods 92 are fastened to the frame 91 above the partitions 94 and run crosswise to the partitions 94 and extend in the vertical direction. A collecting grid 15 is provided below each electrode 88 to collect the water jets from the electrode 88. Each collecting grid 15 is fastened to two brackets 15' which are welded to the inside of the vessel 1 and protrude horizontally into the vessel space (FIG. 3).

Referring to FIGS. 1 and 2, a collecting means is mounted in stationary manner within the vessel 1 in a horizontal plane between each water distribution box 72 and an associated electrode 88. Each collecting means includes a collecting dish 95 which is secured, as by welding, to a vertical run-off pipe 96 and which is located in the range of rotation of an associated distribution box 72 but outside of an associated electrode 88. That is, the collecting dish 95 is vertically disposed below at least a portion of the distribution box 72 at all times while being vertically out of alignment with the electrode 88. The run off pipes 96 are fastened by means of U-bolts 97 to U-shaped strip steel brackets 98, which are welded to the wall of the vessel 1. As seen in FIG. 4, the upper left boundary edge 99 of each collecting dish 95 runs approximately radially to the pipe 67 and extends, in the position of the distribution box 72 shown in FIG. 2, underneath this box 72 between the slot 78 and the row of nozzle openings 76 adjacent to this slot 78.

In the operation of the steam generator, water is taken from the sump of the vessel 1 by means of the circulating pump 7 and pumped via the rotatable central pipe 67 into the three distribution boxes 72. The three distribution boxes 72 thus form a water chamber in which the water to be evaporated collects as a layer of a certain height. From the distribution boxes 72, the water passes via the nozzle openings 76 to the associated electrode 88 in the form of water jets while any excess pumped by the circulating pump 7 flows over the upper edge of the plate 79 into the overflow slot 78 and thence into the associated collecting dish 95. For full load, the distribution boxes 72 are in the position shown in FIG. 2, i.e. vertically over the electrodes 88, so that all the water jets issuing from the nozzle openings 76 strike the electrodes 88. The excess water flowing out from the slots 78 returns via the collecting dishes 95 and the run off pipes 96 to the sump. The water of the water jets coming from the boxes 72 collects row by row between the partitions 94 of the dish-shaped electrodes 88 and is distributed anew and flows via the outlets 90 to the collecting grid 15, again in the form of jets.

The three-phase current fed-in via the three conductor rods 87 flows from the dish-shaped electrodes 88 on the one hand toward the nozzle plates 75, against the falling water, and on the other hand, in the direction of the falling water, to the collecting grids 15. The nozzle plates 75 as well as the collecting grids 15 are electrically connected to the vessel 1 and are at zero potential. During the passage of the current, steam is generated which collects under the top cover 3 and is conducted via a line 51 to consumers (not shown). The amount of steam leaving the vessel 1 is replaced by feed water, which is fed to the vessel 1, via a line 50 connected to the bottom cover 2 by means of a feed water pump, not shown.

If the load is reduced, the pipe 67 is rotated via the drive shaft 80 so that the distribution boxes 72 are gradually moved away from the associated electrode 88 in the horizontal direction clockwise as viewed in FIG. 2. Thus, one jet after the other from each box 72 no longer strikes the associated electrode 88 and is received by the associated collecting dish 95 from where the water is returned to the sump via the run-off pipe 96. Accordingly, the steam generation is reduced while the electric voltage remains constant.

A man hole stub 100 is provided in the cylindrical wall of the vessel 1 through which all components of the steam generator can be brought into the vessel 1 and assembled.

The steam generator according to the invention may also be equipped with only one electrode instead of with three electrodes. The invention is not limited to vessels with a vertical axis. It is also possible to use cylindrical vessels with a horizontal axis, in which case, the dish-shaped electrodes are arranged staggered in the direction of the horizontal axis. Accordingly, also the distribution boxes are then arranged to be axially movable.

What is claimed is.

1. In an electric steam generator, the combination comprising a vessel;

at least one horizontally extending dish-shaped stationary electrode in said vessel for receiving and heating a supply of water and having openings therein forming outlets for the received water to form vertical water jets;

a horizontally movable water distribution means located above each of said at least one electrode for movement relative to each of said at least one electrode in a range between a first position corresponding to a partial load on the generator and a second position corresponding to a full load on the generator, said distribution means having a chamber to receive water, said chamber including a horizontal bottom having a group of openings above each of said at least one electrode for directing vertical water jets against and into each of said at least one electrode; and, a water collecting means mounted in stationary manner in said vessel in a horizontal plane between said distribution means and each of said at least one electrode, said collecting means being vertically disposed below at least a portion of said distribution means when said distribution means is within said range and vertically out of alignment with each of said at least one electrode for collecting that portion of the water not directed at each of said at least one electrode.

2. The combination as set forth in claim 1 which further comprises a collecting grid below each of said at least one electrode to collect the water jets from each of said at least one electrode.

3. The combination as set forth in claim 1 wherein said vessel is disposed on a vertical axis and said distribution means is rotatably mounted on said axis.

4. The combination as set forth in claim 3 wherein said distribution means includes a pipe coaxial with said axis, and wherein said generator further comprises a central pipe stub protruding into said vessel and having said pipe rotatably thereon below a level of water in said vessel and means for feeding water from within said vessel through said pipe stub into said pipe to said distribution.

5. The combination as set forth in claim 4 which further includes a rotatable drive shaft extending through an upper end of said vessel and connected to said pipe for rotating said pipe.

6. The combination as set forth in claim 5 which further comprises a stuffing gland sealing said drive shaft in said vessel upper end.

7. The combination as set forth in claim 1 wherein said distribution means includes a slot-like overflow opening adjacent said openings in said bottom, said overflow opening being disposed vertically above said collecting means to deliver overflow thereto.

8. The combination as set forth in claim 1 which includes a plurality of said electrodes and an equal number of said distribution means.

* * * * *

UNITED STATES PATENT AND TRADEMARK OFFICE

CERTIFICATE OF CORRECTION

PATENT NO. : 4,101,758

DATED : July 18, 1978

INVENTOR(S) : Briton Sprague

It is certified that error appears in the above-identified patent and that said Letters Patent are hereby corrected as shown below:

Column 2, line 19, change "by" to --for--

Column 6, line 15, after "rotatably" insert --supported--

Column 6, line 18, after "distribution" insert --means--

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*